US011430605B2

(12) United States Patent
Yamashita

(10) Patent No.: US 11,430,605 B2
(45) Date of Patent: Aug. 30, 2022

(54) METHOD FOR PRODUCING METAL FOILS

(71) Applicant: TOYOTA JIDOSHA KABUSHIKI KAISHA, Toyota (JP)

(72) Inventor: Osamu Yamashita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 150 days.

(21) Appl. No.: 16/876,719

(22) Filed: May 18, 2020

(65) Prior Publication Data

US 2020/0373084 A1 Nov. 26, 2020

(30) Foreign Application Priority Data

May 23, 2019 (JP) ..... JP2019-097122

(51) Int. Cl.
*H01F 41/02* (2006.01)
*H01F 1/153* (2006.01)
*C21D 8/12* (2006.01)

(52) U.S. Cl.
CPC ..... *H01F 41/0213* (2013.01); *C21D 8/1272* (2013.01); *H01F 1/153* (2013.01); *C21D 2201/03* (2013.01)

(58) Field of Classification Search
CPC ... C21D 1/04; C21D 1/26; C21D 1/28; C21D 1/30; C21D 1/32; C21D 6/00; C21D 6/001; C21D 6/002; C21D 6/004; C21D 6/005; C21D 6/007; C21D 6/008; C21D 8/00; C21D 8/005; C21D 8/12; C21D 8/1244; C21D 8/125; C21D 8/1255; C21D 8/1261; C21D 8/1266; C21D 8/1272; C21D 9/0068; C21D 9/46; C21D 9/48; C21D 2201/03; H01F 1/14716; H01F 1/14725; H01F 1/14775; H01F 1/14783; H01F 1/153; H01F 1/15308; H01F 1/15316; H01F 1/15325; H01F 1/15333; H01F 1/16; H01F 1/18; H01F 13/00; H01F 41/0213; H01F 41/022; H01F 41/0226; H01F 41/0233;
(Continued)

(56) References Cited

U.S. PATENT DOCUMENTS

2017/0229237 A1 8/2017 Makino et al.
2019/0077622 A1 3/2019 Ando et al.
(Continued)

FOREIGN PATENT DOCUMENTS

CN 104139996 A 11/2014
CN 107043847 A 8/2017
(Continued)

*Primary Examiner* — Vanessa T. Luk
(74) *Attorney, Agent, or Firm* — Sughrue Mion, PLLC

(57) ABSTRACT

There is provided a method for producing metal foils, capable of easily crystalizing amorphous soft magnetic material of a plurality of metal foils into nano-crystal magnetic by uniformly heating the metal foils. Separating members (magnets) are disposed on the opposite sides of a laminate, which has been obtained by laminating a plurality of metal foils made of amorphous soft magnetic material, in the laminated direction of the laminate, and the metal foils forming the laminate are magnetized with the magnets. Thus, the adjacent metal foils are separated from each other in the laminated direction and a gap is formed between the metal foils. The metal foils are heated with the gap formed therebetween so that the amorphous soft magnetic material of each metal foil is crystalized into nano-crystal magnetic material.

2 Claims, 10 Drawing Sheets

(58) Field of Classification Search
CPC ..... B65G 59/00; B65G 59/02; B65G 59/04; B65G 59/045; B65G 59/06; B65G 59/061; B65G 59/067; B65G 59/068
See application file for complete search history.

(56) References Cited

U.S. PATENT DOCUMENTS

| | | | |
|---|---|---|---|
| 2019/0123376 | A1 | 4/2019 | Ando et al. |
| 2019/0157921 | A1 | 5/2019 | Nishikawa et al. |

FOREIGN PATENT DOCUMENTS

| | | | |
|---|---|---|---|
| CN | 108778967 | A | 11/2018 |
| CN | 109417318 | A | 3/2019 |
| JP | 2017-141508 | A | 8/2017 |
| JP | 2017-185675 | A | 10/2017 |

METHOD FOR PRODUCING METAL FOILS

CROSS REFERENCE TO RELATED APPLICATIONS

The present application claims priority from Japanese patent application JP 2019-097122 filed on May 23, 2019, the entire content of which is hereby incorporated by reference into this application.

BACKGROUND

Technical Field

The present disclosure relates to a method for producing metal foils made of nano-crystal magnetic material.

Background Art

Conventional motors, transformers, and the like include a laminate obtained by laminating metal foils as a core. For example, JP 2017-141508 A suggests a method for producing metal foils, including heating metal foils made of amorphous soft magnetic material in a laminated state to crystalize the amorphous soft magnetic material of the metal foils into nano-crystal magnetic material.

SUMMARY

It is commonly known that when amorphous soft magnetic material is crystalized into nano-crystal magnetic material, the material generates heat by itself. Therefore, as described in JP 2017-141508 A, for example, heating metal foils in a laminated state may cause the metal foils to be excessively heated due to the accumulation of heat generated by the material between the metal foils. Furthermore, among the laminated metal foils, variation in heating temperature occurs between the metal foils located inside and the metal foils located outside.

In view of the foregoing, if a plurality of metal foils is heated while separated from each other, instead of being laminated on each other, each metal foil can be uniformly heated. However, the process of separating the plurality of metal foils one by one requires enormous amounts of time.

The present disclosure provides a method for producing metal foils, capable of easily crystalizing amorphous soft magnetic material of a plurality of metal foils into nano-crystal magnetic material by uniformly heating the metal foils.

Accordingly, the method for producing metal foils according to the present disclosure is a method for producing metal foils made of nano-crystal magnetic material, the method including disposing separating members each including at least a magnet on the opposite sides of a laminate, which has been obtained by laminating a plurality of metal foils made of amorphous soft magnetic material, in the laminated direction of the laminate, and magnetizing the metal foils forming the laminate using the magnet, so as to separate the metal foils that are adjacent to each other in the laminated direction and form a gap between the metal foils, and heating the plurality of metal foils with the gap formed therebetween, thereby crystalizing the amorphous soft magnetic material of each of the metal foils into nano-crystal magnetic material.

According to the present disclosure, the separating members are disposed on the opposite sides of the laminate and the metal foils are magnetized with the magnets of the separating members so that adjacent metal foils are separated from each other and a gap is formed therebetween. In this manner, the plurality of metal foils can be easily arranged at some intervals between the separating members as a result of the metal foils having been magnetized and repelled each other.

When the plurality of metal foils is heated while a gap is formed therebetween so that the amorphous soft magnetic material is crystalized, heat is inputted into each metal foil. During the crystallization, each metal foil generates heat by itself, but since the generated heat is discharged through the gap between the metal foils, it is possible to avoid an excessive temperature rise of the metal foils. As a result, each metal foil can be uniformly heated, and a metal foil made of nano-crystal magnetic material having a uniform crystal structure can be obtained.

Each separating member may include a magnet, or soft magnetic material such as iron may be provided on a surface of the magnet. However, in some embodiments, a portion of each separating member facing the laminate includes a first portion and a second portion alternately disposed in the laminated direction of the laminate, the first portion being adapted to magnetize one of the metal foils using the magnetism of the magnet, the second portion being adapted to block the magnetism of the magnet.

According to this aspect, since the portion of each separating member facing the laminate includes the first portion, which is adapted to magnetize one of the metal foils, and the second portion, which is adapted to block the magnetism of the magnet, that are alternately disposed in the laminated direction of the laminate, the plurality of metal foils is arranged with a gap formed therebetween by being magnetized by the first portion.

In this arrangement, for example, if impact is applied to each metal foil during delivery or hot air is blown on each metal foil in the crystallization step, the attitude of each metal foil may change. Even in such a case, since the second portion adapted to block the magnetism of the magnet is disposed between the adjacent metal foils, even if part of each metal foil becomes likely to fall off the first portion, the attitude of the metal foil may be corrected with the magnetic force of the first portion. Accordingly, the state where a gap is formed between the metal foils can be maintained.

According to the method for producing metal foils of the present disclosure, a plurality of metal foils made of amorphous soft magnetic material is uniformly heated so that the amorphous soft magnetic material can be easily crystalized into nano-crystal magnetic material.

DETAILED DESCRIPTION

Figure 1A:
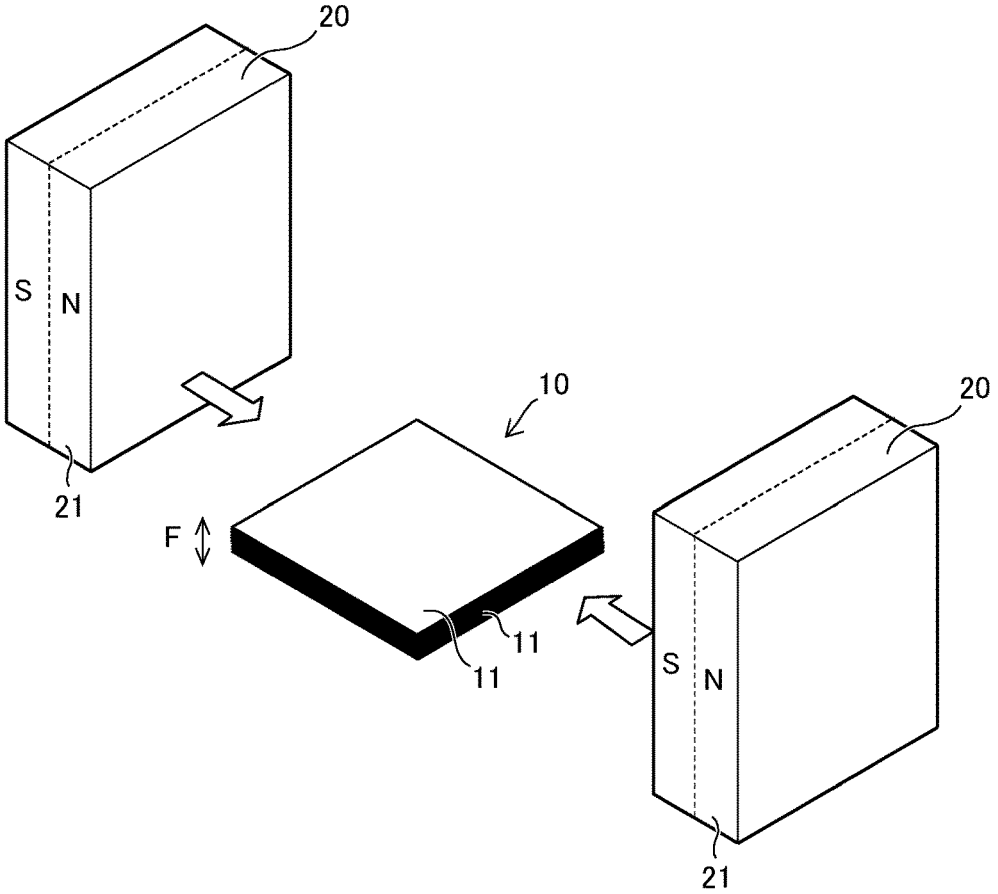
FIG. 1A is a schematic perspective view for explaining a state before the step of forming a gap between a plurality of metal foils is performed in a method for producing metal foils according to a first embodiment of the present disclosure.

Hereinafter, a method for producing metal foils according to the present disclosure will be described with reference to the drawings. With reference to FIG. 1A to FIG. 8F, metal foils to be used will be described first, and then a production method therefor according to each embodiment will be described.

1. Metal Foil

Metal foils produced in the present embodiment are metal foils made of nano-crystal soft magnetic material. The production method described below includes applying heat treatment to metal foils made of amorphous soft magnetic material to crystalize the amorphous soft magnetic material into nano-crystal magnetic material, thereby producing metal foils.

Now, amorphous soft magnetic material or nano-crystal soft magnetic material forming metal foils will be described. Examples of the amorphous soft magnetic material and nano-crystal soft magnetic material include, but are not limited to, material containing at least one magnetic metal selected from the group consisting of Fe, Co, and Ni and at least one non-magnetic metal selected from the group consisting of B, C, P, Al, Si, Ti, V, Cr, Mn, Cu, Y, Zr, Nb, Mo, Hf, Ta, and W.

Typical examples of the amorphous soft magnetic material or nano-crystal soft magnetic material include, but are not limited to, a FeCo-based alloy (e.g., FeCo and FeCoV), a FeNi-based alloy (e.g., FeNi, FeNiMo, FeNiCr, and FeNiSi), a FeAl-based alloy or a FeSi-based alloy (e.g., FeAl, FeAlSi, FeAlSiCr, FeAlSiTiRu, and FeAlO), a FeTa-based alloy (e.g., FeTa, FeTaC, and FeTaN) or a FeZr-based alloy (e.g., FeZrN). A Fe-based alloy may contain at least 80 at % of Fe.

As another example of the amorphous soft magnetic material or nano-crystal soft magnetic material, a Co-based alloy containing Co and at least one of Zr, Hf, Nb, Ta, Ti, or Y may be used. The Co-based alloy may contain at least 80 at % of Co. Such a Co-based alloy is likely to become an amorphous state when it is deposited as a film, and exhibits excellent soft magnetism because it has small magnetocrystalline anisotropy and few crystal defects and grain boundaries. Examples of the amorphous soft magnetic material include CoZr, CoZrNb, and CoZrTa-based alloys.

The amorphous soft magnetic material as used herein is soft magnetic material having an amorphous structure as a main structure. In the amorphous structure, no clear peak appears in an X-ray diffraction pattern, and only a broad halo pattern can be observed. Meanwhile, a nano-crystal structure can be formed by applying heat treatment to the amorphous structure, and in a nano-crystal soft magnetic material having a nano-crystal structure, a diffraction peak can be observed in a position corresponding to a gap between lattice points on the crystal plane. Based on the width of the diffraction peak, the crystallite size can be calculated with the Scherrer equation.

In the nano-crystal soft magnetic material as used herein, each nano-crystal has a crystallite size of less than 1 μm as calculated with the Scherrer equation based on the full width at half maximum (FWHM) of a diffraction peak of an X-ray diffraction pattern. In the present embodiment, the crystallite size of each nano-crystal (the crystallite size as calculated with the Scherrer equation based on the full width at half maximum (FWHM) of a diffraction peak of an X-ray diffraction) may be equal to or less than 100 nm, or equal to or less than 50 nm. In addition, the crystallite size of each nano-crystal may be equal to or greater than 5 nm. If nano-crystals have a crystallite size within such a range, magnetic properties can be improved. Meanwhile, the crystallite size of a conventional electromagnetic steel sheet is of the order of μm, and typically equal to or greater than 50 μm.

The amorphous soft magnetic material can be obtained by, for example, melting metal material, which has been prepared to have the above-mentioned composition, at a high temperature in a high-frequency melting furnace or the like to obtain a uniform molten metal and quenching the result. The quenching rate is, for example, about $10^{6\circ}$ C./sec, though it depends on the material used. However, the quenching rate is not particularly limited as long as an amorphous structure can be obtained before the material crystallizes. In the present embodiment, the metal foil as will be described later can be obtained by blowing the molten metal of the metal material onto a rotating cooling roll to produce a metal foil strip made of amorphous soft magnetic material and forming the strip into a desired shape by punching, for example. In this manner, quenching a molten metal can obtain soft magnetic material having an amorphous structure before the material crystalizes. The metal foil may have a thickness not greater than 0.05 mm, for example, and not less than 0.01 mm, for example. It should be noted that in the drawings as will be described later, the metal foil formed is a rectangular metal foil or a fan-shaped metal foil according to the shape of a rotor core of a motor, but the shape of the metal foil is not limited to them.

In the present embodiment, metal foils made of nano-crystal magnetic material are produced from the thus-prepared metal foils made of amorphous soft magnetic material. Now, some embodiments according to the present disclosure will be described.

First Embodiment

As illustrated in FIG. 1A, in the present embodiment, a plurality of metal foils 11 made of amorphous soft magnetic material is prepared as described above. Specifically, in the present embodiment, as described above, the metal foils 11 are punched out from a metal foil strip made of amorphous soft magnetic material, and have identical shapes. Although the present embodiment illustrates rectangular metal foils as an example, the metal foils may have any shape depending on the intended use.

Next, a laminate 10 is produced by overlaying the plurality of metal foils 11 as prepared. The laminate 10 results from laminating the metal foils 11 such that each metal foil 11 is movable. The metal foils 11 are not tied to each other and can be separated from each other. The number of metal foils 11 to be laminated is not particularly limited as long as the plurality of metal foils 11, 11 is arranged such that a gap C is formed therebetween in the laminated direction in the state illustrated in FIG. 1B.

Figure 1B:
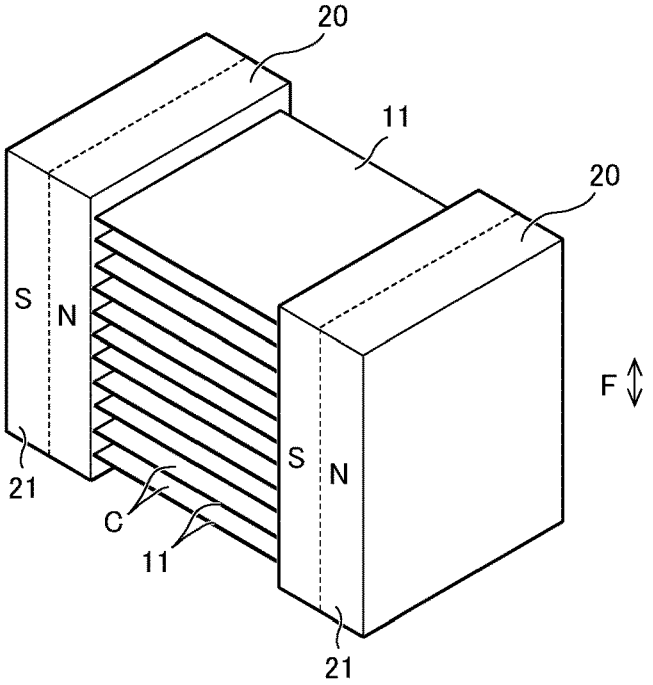
FIG. 1B is a schematic perspective view for explaining a state where the step of forming a gap between a plurality of metal foils has been performed in the method for producing metal foils according to the first embodiment of the present disclosure.

As illustrated in FIG. 1B, the plurality of metal foils 11 forming the laminate 10 in this state is separated from each other using separating members 20. The separating members as used in the present disclosure include magnets, and in the present embodiment, the separating members 20 are magnets 21. It should be noted that a member made of iron-based soft magnetic material, such as carbon steel, can be further provided on the surface of a portion of each magnet 21 facing the laminate 10, as long as each metal foil 11 can be magnetized with the magnetism of the magnet 21. In the present embodiment, the magnet 21 is a permanent magnet, and for the magnet 21, a rare-earth magnet, such as a neodymium magnet mainly including neodymium, iron, and boron and a samarium-cobalt magnet mainly including samarium and cobalt, is used. In addition, a ferrite magnet, an alnico magnet, and the like may also be used. The magnet 21 may also be an electromagnet including an iron core and a coil.

As illustrated in FIG. 1B, in the present embodiment, a pair of separating members 20, 20 (a pair of magnets 21, 21) is disposed on the opposite sides of the laminate 10 in the laminated direction of the laminate 10. More specifically, the magnets 21 are put closer to the laminate 10 from the opposite sides of the laminate 10. Accordingly, the metal foils 11 forming the laminate 10 are magnetized by the magnets 21, whereby the adjacent metal foils 11, 11 are separated from each other in the laminated direction and the gap C is formed between the metal foils 11, 11. The gap C may be 1 to 10 mm in length, and may be determined by the magnetic force of the magnets 21, for example.

In this manner, the plurality of metal foils 11, 11 can be easily arranged in a state where the metal foils 11, 11, which are magnetized by the magnets 21, repel each other and the plurality of metal foils 11, 11 has a gap formed therebetween, between the magnets 21. In the present embodiment, each metal foil 11 is in contact with each separating member 20, but each metal foil 11 need not be in contact with each separating member 20 as long as the gap C can be formed between the metal foils 11, 11. The same applies to the other embodiments described later.

In FIG. 1A and FIG. 1B, the pole of one of the pair of magnets 21 on the side facing the laminate 10 is the north pole, and the pole of the other magnet 21 on the side facing the laminate 10 is the south pole. However, as long as the plurality of metal foils 11 can be magnetized by the magnets 21, the magnetized (magnetic) metal foils 11, 11 repel each other regardless of the poles of the magnets 21. Therefore, the magnets 21, 21 may also be disposed with respect to the laminate 10 such that the pole of one of the pair of magnets 21 on the side facing the laminate 10 is equal to the pole of the other magnet 21 on the side facing the laminate 10.

Next, the plurality of metal foils 11, 11 is heated (subjected to heat treatment) in the state illustrated in FIG. 1B, that is, with the gap C formed between the metal foils 11, 11, whereby the amorphous soft magnetic material of each metal foil 11 is crystalized into nano-crystal magnetic material.

In this manner, if the plurality of metal foils 11, 11 is heated so that the amorphous soft magnetic material is crystalized in a state where the gap C is formed between the metal foils 11, 11, heat is inputted to each metal foil 11. During this crystallization, each metal foil 11 generates heat by itself, but since the generated heat is discharged through the gap C between the metal foils 11, 11, it is possible to avoid an excessive temperature rise of the metal foil 11. As a result, each metal foil 11 can be uniformly heated, and the metal foil 11 made of nano-crystal magnetic material having uniform crystals can be obtained.

The conditions of heat treatment for each metal foil 11 are not particularly limited as long as the material can be crystalized, and may be appropriately selected in consideration of the composition of metal material and the desired magnetic properties to be obtained, for example. Therefore, the temperature of the heat treatment is higher than the crystallization temperature of the soft magnetic material of the metal foil, for example, though not particularly limited thereto. Accordingly, performing heat treatment on the amorphous soft magnetic material allows the amorphous soft magnetic material to change (be crystalized) into nano-crystal soft magnetic material. The heat treatment may be performed in an inert gas atmosphere.

The crystallization temperature is a temperature at which crystallization occurs. Since exothermic reaction occurs during crystallization, the crystallization temperature may be determined by measuring the temperature at which heat is generated along with the crystallization. For example, the crystallization temperature can be measured under the condition of a predetermined heating rate (e.g., 0.67 $Ks^{-1}$) using differential scanning calorimetry (DSC). The crystallization temperature of amorphous soft magnetic material is, for example, from 300 to 500° C., though it differs depending on the material used. Similarly, the crystallization temperature of nano-crystal soft magnetic material can also be measured using differential scanning calorimetry (DSC). Although nano-crystal soft magnetic material already has crystals generated therein, crystallization further progresses if the nano-crystal soft magnetic material is heated to the crystallization temperature or higher. The crystallization temperature of nano-crystal soft magnetic material is, for example, from 300 to 500° C., though it differs depending on the material used.

The heating temperature in this step is not particularly limited as long as it is equal to or higher than the temperature at which amorphous soft magnetic material crystalizes into nano-crystal soft magnetic material. For example, the heating temperature may be equal to or higher than 350° C., or equal to or higher than 400° C. Setting the heating temperature to 400° C. or higher allows crystallization to progress efficiently. Further, the heating temperature may be equal to or lower than 600° C., or equal to or lower than 520° C., for example. Setting the heating temperature to 520° C. or lower can more easily avoid excessive crystallization and suppress generation of by-products (for example, $Fe_2B$).

The heating time for the crystallization step is not particularly limited, but may be not shorter than 1 second and not longer than 10 minutes, or not shorter than 1 second and not longer than 5 minutes.

The method for heating each metal foil is not particularly limited as long as the metal foil can be uniformly heated, and any method can be used, such as heating in an atmosphere in a high-temperature heating furnace, heating with an infrared heater, heating with an electromagnetic coil, and heating with heated hot air.

For example, among the above-described heating methods, the metal foil 11 may be heated with heated gas (hot air). More specifically, in the present embodiment, as illustrated in FIG. 1B, each metal foil 11 is heated with heated gas flowed through the gap C formed between the metal foils 11, 11.

As a result, due to the gas flowing through the gap C, the gas having a stable temperature flows on the surface of each metal foil 11, and thus each metal foil 11 is uniformly heated. In addition, even when the metal foil 11 generates heat by itself during crystallization, and the surface temperature of the metal foil 11 locally rises to the heating temperature or higher, since the temperature of the gas flowing on the surface is lower than the surface temperature of the metal foil 11 while it generates heat, it is possible to discharge the heat generated by the metal foil 11 to the gas passing over the surface of the metal foil 11. Accordingly, the surface temperature of the metal foil 11 can be maintained more evenly.

Figure 2:
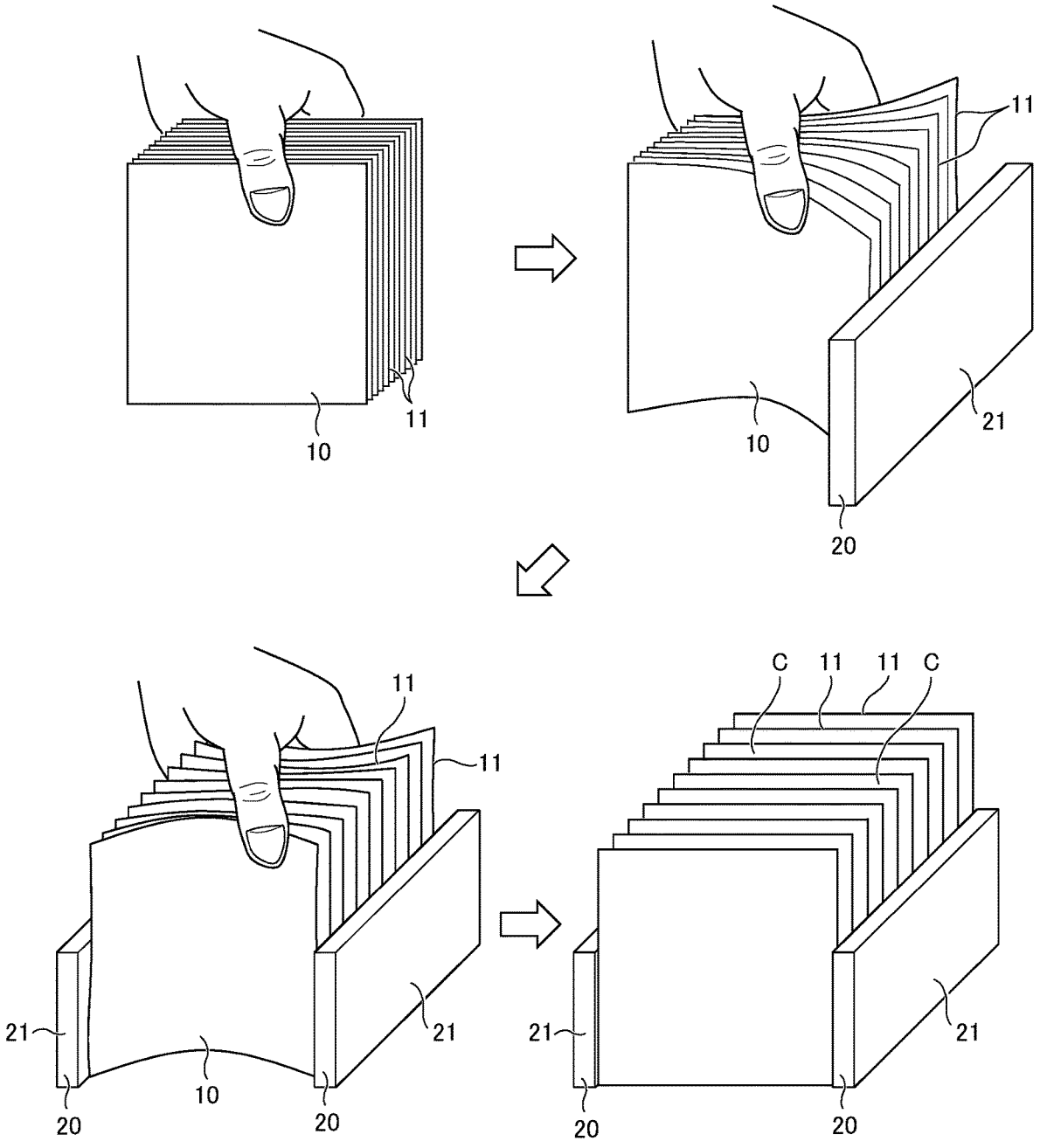
FIG. 2 is a view for explaining the principle of forming a gap between a plurality of metal foils using a magnet.

In the first embodiment, as illustrated in FIG. 1A, the laminate 10 is formed with the metal foils 11 being stacked by their own weight, but for example as illustrated in the top left view in FIG. 2, the laminate 10 may be held from its opposite sides in the laminated direction, for example, if the plurality of metal foils 11 is laminated while they are not tied to each other (movable). In the top left view in FIG. 2, an operator is holding the opposite sides of the laminate 10 in the laminated direction, for example.

Now, as illustrated in the top right view of FIG. 2, when the laminate 10 is put closer to the separating member 20 (magnet 21) from one side of the laminate 10, the metal foils 11 forming the laminate 10 are magnetized (become magnetic). Since the edge portions of the metal foils 11 facing the separating member 20 (magnet 21) are not tied to each other, these edge portions repel each other and are separated from each other.

Next, as illustrated in the bottom left view in FIG. 2, when another separating member 20 (magnet 21) is further put closer to the laminate 10 from the other side of the laminate 10, since the other edge portions of the metal foils 11 facing the other separating member 20 (magnet 21) are not tied to each other, either, these edge portions repel each other and are separated from each other.

Finally, as illustrated in the bottom right view in FIG. 2, when the hand holding the opposite sides of the laminate 10 in the laminated direction releases the laminate 10, the plurality of metal foils 11 forming the laminate 10 is completely separated from each other in the laminated direction, whereby the gap C is formed between the metal foils 11.

As described above, as illustrated in FIG. 1A to FIG. 2, when the separating members 20 (magnets 21) are disposed on the opposite sides of the laminate 10, which has been formed by laminating the plurality of metal foils 11, 11, each metal foil 11 is magnetized by the magnets 21 and the metal foils 11 can be separated from each other. Accordingly, even if the pair of separating members 20 (magnets 21) is not put relatively closer to the laminate 10 from its opposite sides, releasing the state of the laminate 10 held between the pair of magnets 21, 21 will allow the plurality of metal foils 11, 11 to be separated from each other. In a second embodiment below, the metal foils 11 are produced using a separating device 30 that has been made from such a perspective.

Second Embodiment

Figure 3A:
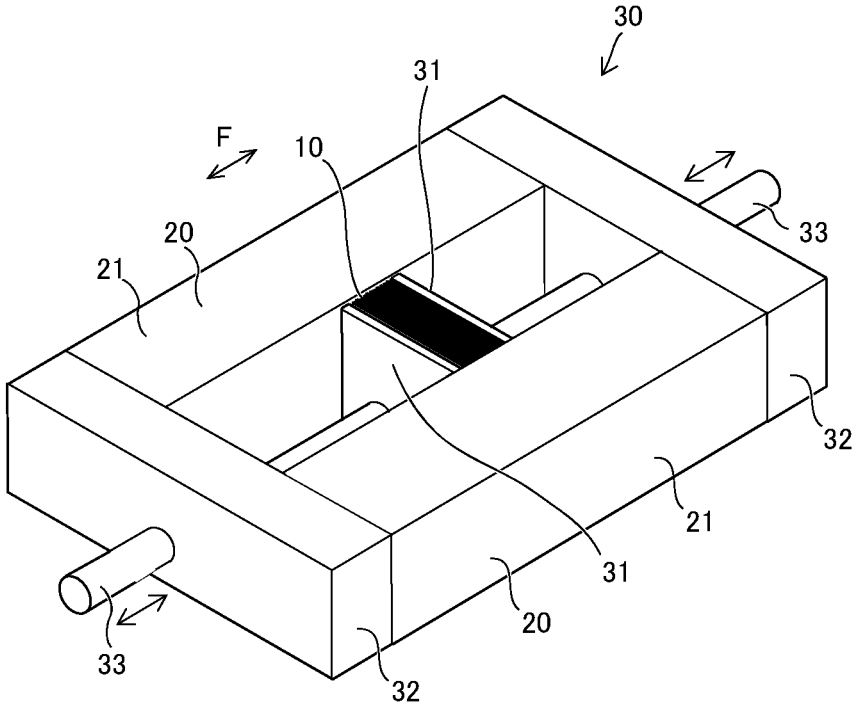
FIG. 3A is a schematic perspective view for explaining a state before the step of forming a gap between a plurality of metal foils is performed in a method for producing metal foils according to a second embodiment of the present disclosure.
Figure 3B:
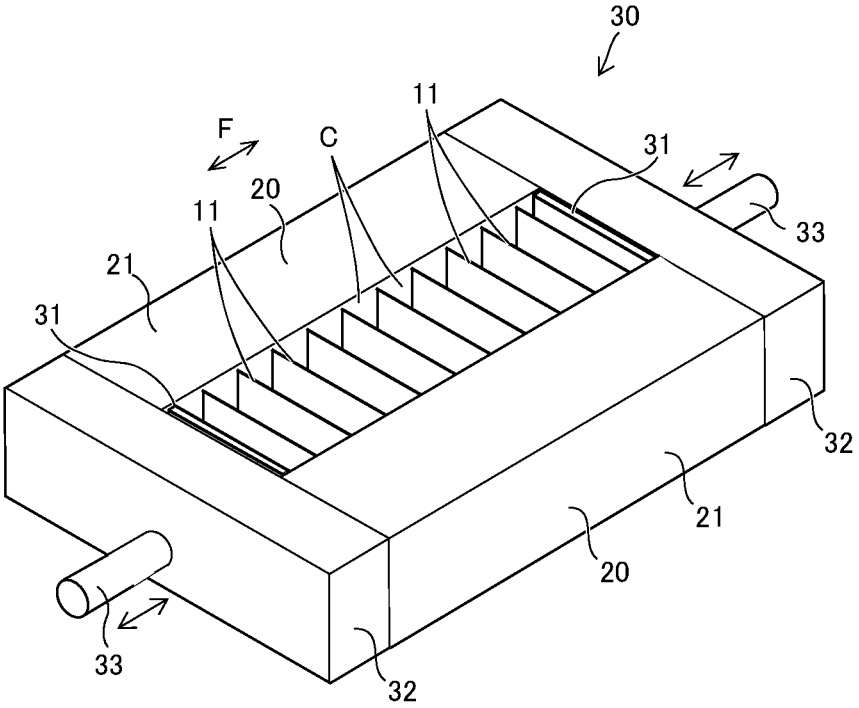
FIG. 3B is a schematic perspective view for explaining a state where the step of forming a gap between a plurality of metal foils has been performed in the method for producing metal foils according to the second embodiment of the present disclosure.

As illustrated in FIG. 3A and FIG. 3B, in the present embodiment, metal foils 11 are produced using the separating device 30. The separating device 30 has a pair of separating members 20, 20 as in the first embodiment. Also in the present embodiment, each separating member 20 includes a magnet 21, and the separating members 20, 20 are fixed at opposite sides by coupling members 32, 32. In the present embodiment, the material of the coupling members 32, 32 is non-magnetic material such as stainless steel and aluminum, though not particularly limited thereto.

A rod 33, which reciprocates in a direction in which the other opposing coupling member 32 is disposed, is inserted through each coupling member 32. In the present embodiment, the rod 33 is coupled to a driving source that causes the rod 33 to reciprocate. For example, the rod 33 is coupled to a driving source, such as a hydraulic or pneumatic actuator having a piston and a cylinder, an electrical actuator having a motor and the like. The driving source of the rod 33 is not particularly limited as long as it can cause the rod 33 to linearly reciprocate.

The end of each rod 33 has a holding plate 31 attached thereto. The holding plate 31 serves to hold a plurality of metal foils 11, 11 in the state of a laminate 10. The holding plate 31 is disposed in a space between the pair of separating members 20, 20 and moves along with the rod 33 within the space.

In a state where the pair of holding plates 31, 31 is positioned closest to each other along with the movement of the rods 33, the distance between the opposing surfaces of the holding plates 31, 31 is equal to or slightly greater than the thickness of the laminate 10 in the laminated direction F. This allows the laminate 10 to be easily inserted between the holding plates 31, 31 and further allows the laminate 10 to be easily removed from the separating device 30 after crystallization.

The metal foils 11 made of nano-crystal magnetic material are produced using such a separating device 30. The second embodiment differs from the first embodiment in that it uses the separating device 30 in the step of forming a gap C between the metal foils 11, 11. Therefore, only this feature will be described, and the description of the same steps will be omitted.

First, as illustrated in FIG. 3A, in the present embodiment, a laminate 10 obtained by laminating metal foils is prepared, and the laminate 10 is sandwiched between the pair of holding plates 31, 31 from the opposite sides of the laminate 10 in the laminated direction. The laminate 10 is shaped and sized to be movable in the laminated direction F within a space formed between the separating members 20, 20. It should be noted that the plurality of metal foils 11, 11 forming the laminate 10 is not tied to each other and overlap each other in a separable manner.

Next, the rods 33 are moved to move the holding plates 31, 31 in the direction away from the laminate 10. Also in the present embodiment, the separating members 20 (magnets 21) are disposed on the opposite sides of the laminate 10 in the laminated direction F of the laminate 10, and the plurality of metal foils 11, 11 forming the laminate 10 is magnetized by the magnets 21 through a series of such process. Therefore, as illustrated in FIG. 3B, after the rods 33 are moved, the adjacent metal foils 11, 11 are separated from each other in the laminated direction F, and a gap C is formed between the metal foils 11, 11.

After that, in the state illustrated in FIG. 3B, the plurality of metal foils 11, 11 attached to the separating device 30 is heated as in the first embodiment to crystallize amorphous soft magnetic material of each metal foil 11 into nano-crystal magnetic material. After the crystallization, the pair of holding plates 31, 31 is moved again to sandwich the plurality of metal foils 11, 11 to form the laminate 10, and then, the laminate 10 is removed from the separating device 30.

Third Embodiment

Figure 4A:
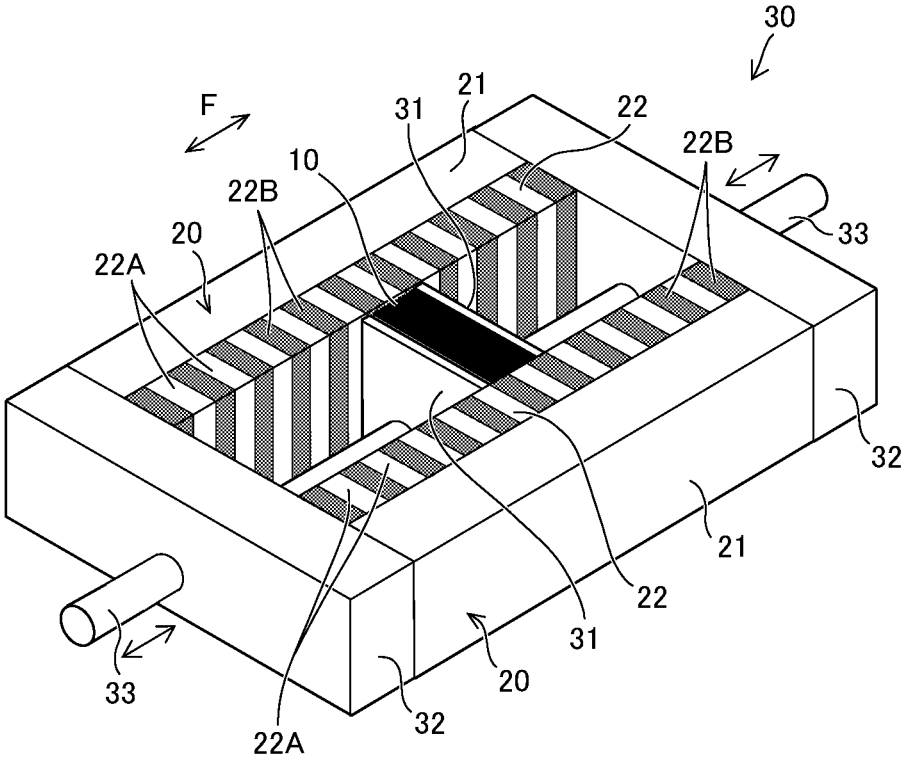
FIG. 4A is a schematic perspective view for explaining a state before the step of forming a gap between a plurality of metal foils is performed in a method for producing metal foils according to a third embodiment of the present disclosure.
Figure 4B:
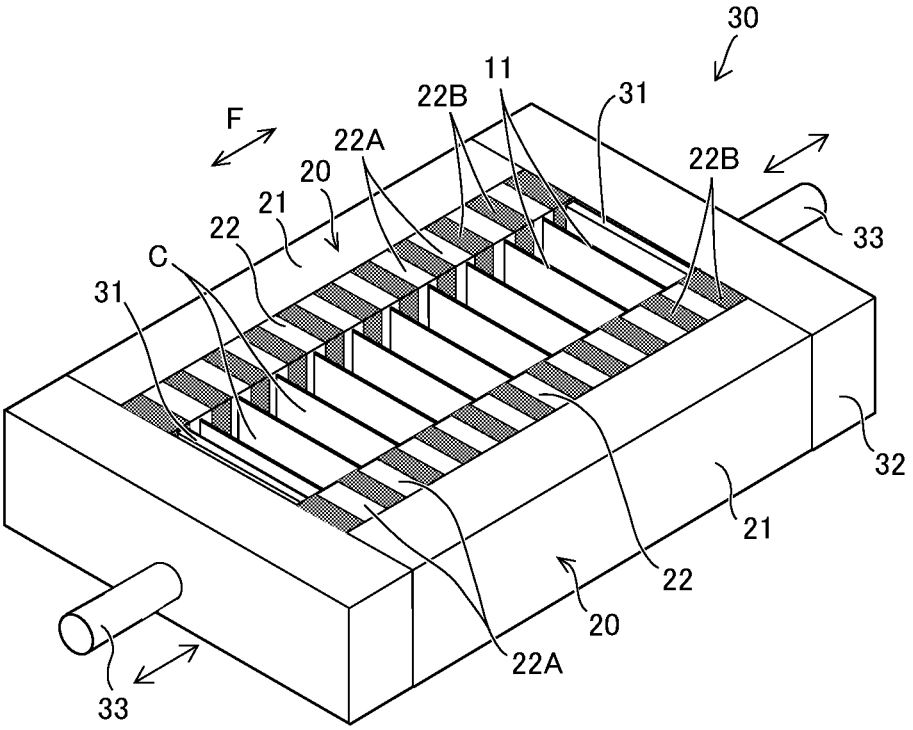
FIG. 4B is a schematic perspective view for explaining a state where the step of forming a gap between a plurality of metal foils has been performed in the method for producing metal foils according to the third embodiment of the present disclosure.

As illustrated in FIG. 4A and FIG. 4B, in the present embodiment, metal foils 11 made of nano-crystal magnetic material are produced using a separating device 30. The separating device 30 of the present embodiment differs from the separating device 30 of the second embodiment in the structures of separating members 20 of the separating device 30.

More specifically, in the present embodiment, as illustrated in FIG. 4A, FIG. 4B, and FIG. 5, a portion 22 of each separating member 20 facing the laminate 10 includes first portions 22A each being adapted to magnetize each metal foil 11 of the laminate 10 with the magnetism of a magnet 21 and second portions 22B each being adapted to block the magnetism of the magnet 21. The first portions 22A and the second portions 22B are alternately disposed in the laminated direction F of the laminate 10. More specifically, in the present embodiment, the first portions 22A are made of iron-based magnetic material such as carbon steel, and the second portions 22B are made of non-magnetic material such as aluminum and resin.

As illustrated in FIG. 4B, the first portions 22A and the second portions 22B may be alternately disposed in the laminated direction F at such intervals that one metal foil 11 is magnetized by each first portion 22A.

In the present embodiment, each first portion 22A only need to be capable of magnetizing each metal foil 11 of the laminate 10 with the magnetism of the magnet 21, and such portion of the first portion 22A may be formed as part of the magnet 21. Furthermore, the first portion 22A may be formed as a magnet so that the magnet 21 may be omitted.

When such separating members 20 are used, the plurality of metal foils 11, 11 is magnetized by the first portions 22A. Therefore, the plurality of metal foils 11, 11 is arranged at some intervals therebetween. Furthermore, since the second portions 22B are portions for blocking the magnetism of the magnet 21, the metal foils 11 are not disposed on the second portions 22B.

In this arrangement, for example, if impact is applied to each metal foil 11 during delivery or hot air is blown on each metal foil in the crystallization step, the attitude of each metal foil 11 may change as illustrated in FIG. 4B.

Figure 5A:
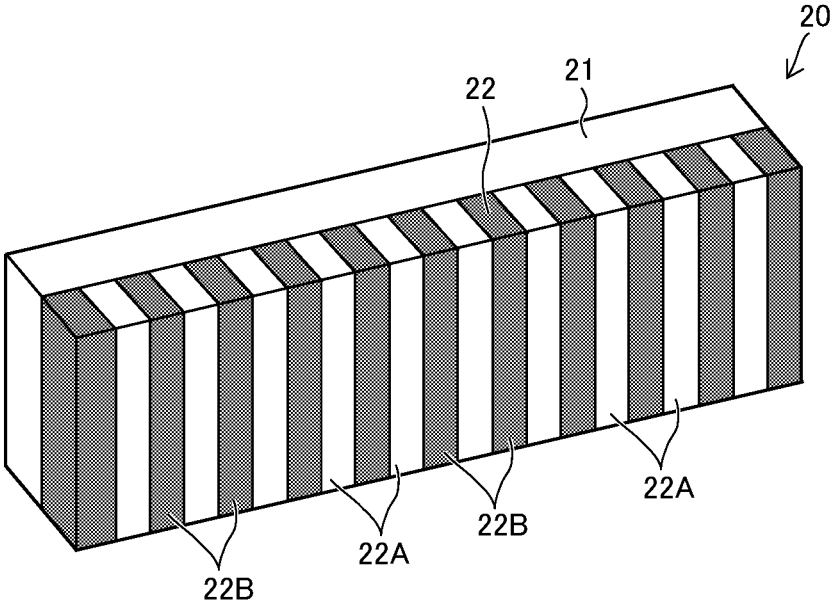
FIG. 5A is a schematic perspective view of a separating member illustrated in FIG. 4A.
Figure 5B:
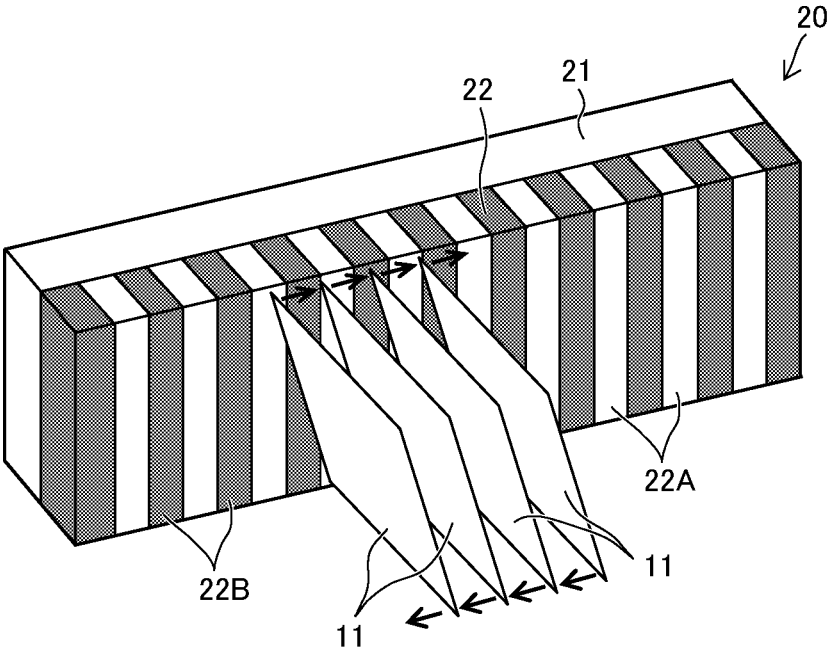
FIG. 5B is a schematic view for explaining correction of the attitudes of metal foils in the state illustrated in FIG. 4B.

However, even in this case, since the second portion 22B for blocking the magnetism of the magnet is disposed between the metal foils 11, 11, even if part of each metal foil 11 becomes likely to fall off the first portion 22A, the attitude of the metal foil 11 is corrected in the arrow direction of FIG. 5B with the magnetic force of the first portion 22A. Accordingly, the state where a gap C is formed between the metal foils 11, 11 can be stably maintained.

Figure 6A:
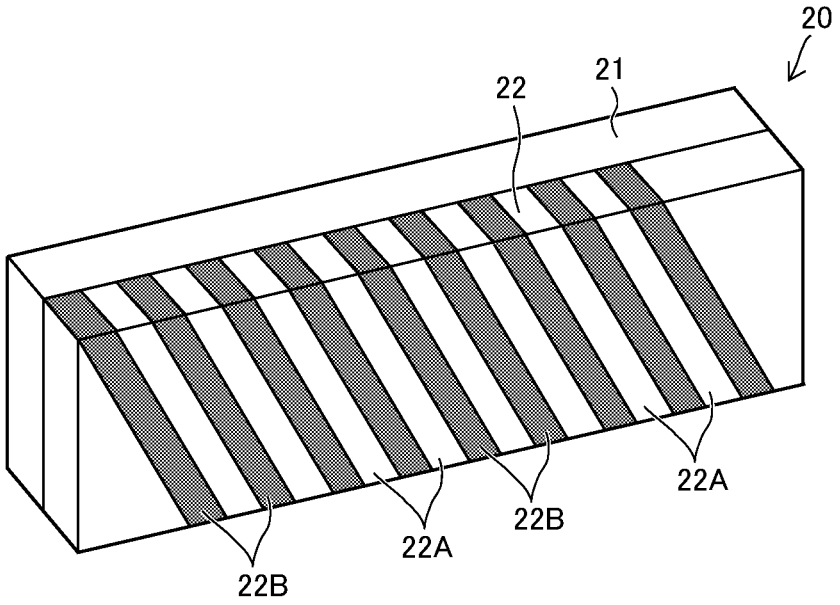
FIG. 6A is a schematic perspective view illustrating a modification example of the separating member illustrated in FIG. 5A.
Figure 6B:
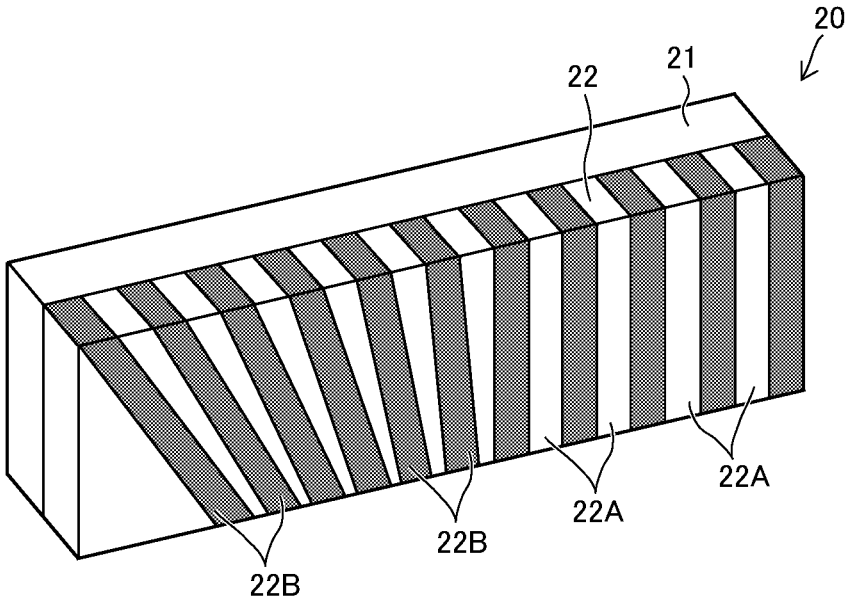
FIG. 6B is a schematic perspective view illustrating another modification example of the separating member illustrated in FIG. 5A.
Figure 7:
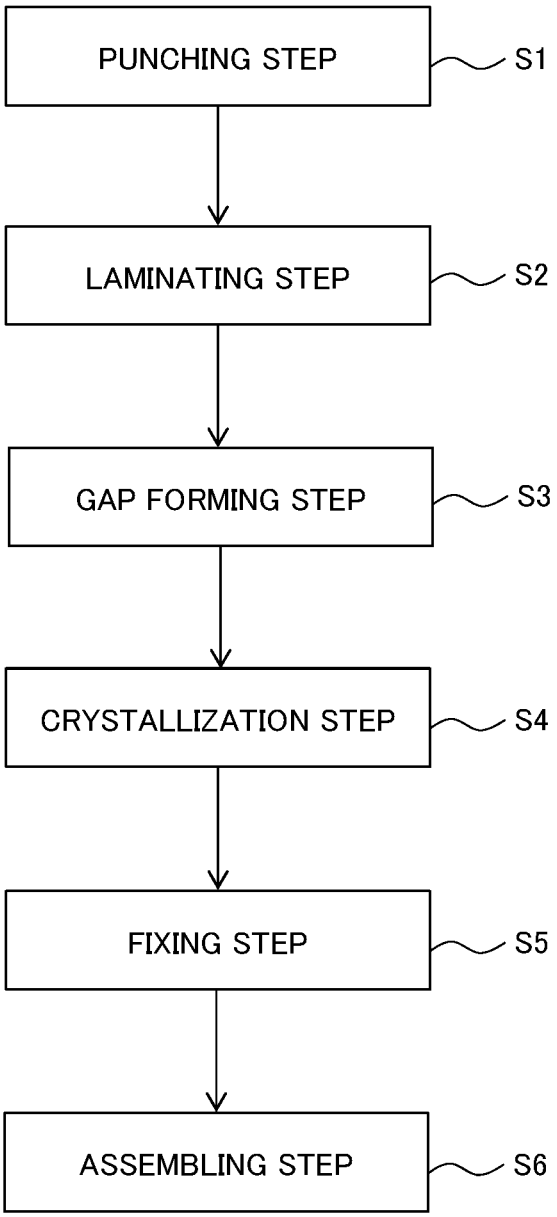
FIG. 7 is a flow chart for explaining a method for producing a motor, using the method for producing metal foils according to the second embodiment of the present disclosure.

In FIG. 5A, the first portions 22A and the second portions 22B are alternately disposed in a direction perpendicular to the laminated direction F. However, as illustrated in FIG. 6A, for example, the first portions 22A and the second portions 22B may be inclined in one direction with respect to the laminated direction or as illustrated in FIG. 6B, part of the first portions 22A and the second portions 22B may be inclined in one direction with respect to the laminated direction F.

Hereinafter, a method for producing a motor will be briefly described with reference to FIG. 7 and FIG. 8A to FIG. 8F.

Figure 8A:
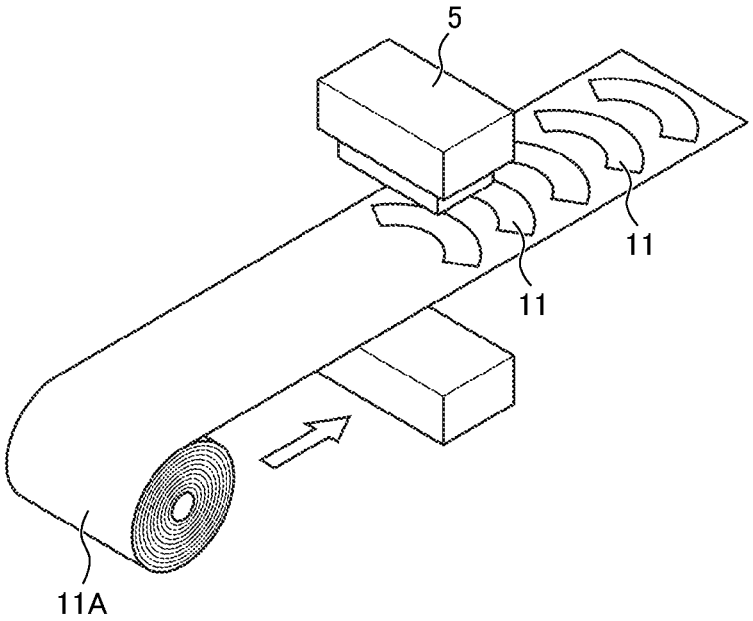
FIG. 8A is a schematic perspective view for explaining a punching step of FIG. 7.
Figure 8B:
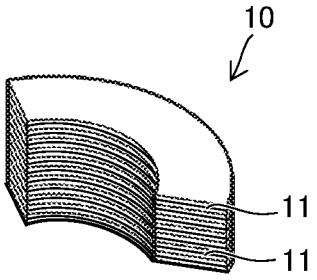
FIG. 8B is a schematic perspective view for explaining a laminating step of FIG. 7.
Figure 8C:
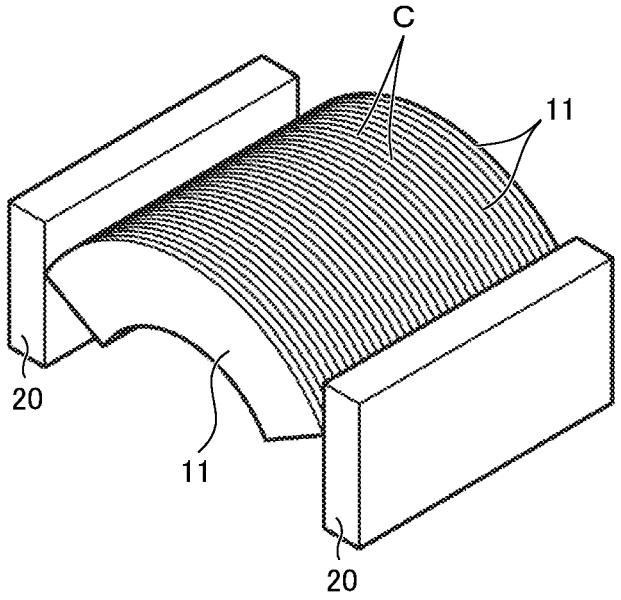
FIG. 8C is a schematic perspective view for explaining a gap forming step of FIG. 7.

First, a punching step S1 is performed. In this step, as illustrated in FIG. 8A, metal foils 11 are punched out from a metal foil strip 11A made of amorphous soft magnetic material as produced according to the above-described production method, using a press 5. Accordingly, a plurality of (e.g., 400) metal foils 11 is prepared. Each metal foil 11 is in the shape of a fan obtained by dividing an annular alloy thin strip forming a stator core of a motor (described later) into one-thirds in the circumferential direction. A portion corresponding to teeth of the stator core is the inner side of the fan shape, and a portion corresponding to a back yoke is the outer side (peripheral side) of the fan shape. In FIG. 8A, details of their shapes are omitted.

Next, a laminating step S2 is performed. In this step, the plurality of metal foils 11 is laminated to produce the laminate 10. The laminate 10 is obtained by overlaying the metal foils 11, 11 so that they are not tied to each other.

Next, a gap forming step S3 is performed. In this step, a pair of separating members 20, 20 is disposed on the opposite sides of the laminate 10. More specifically, the device illustrated in FIG. 3A is used. Accordingly, each metal foil 11 is magnetized. The adjacent metal foils 11, 11 repel each other with the mutual magnetic force of the magnetized metal foils 11, 11. As a result, the metal foils 11, 11 are separated from each other in the laminated direction of the laminate 10, and a gap C is formed between the metal foils 11, 11.

Figure 8D:
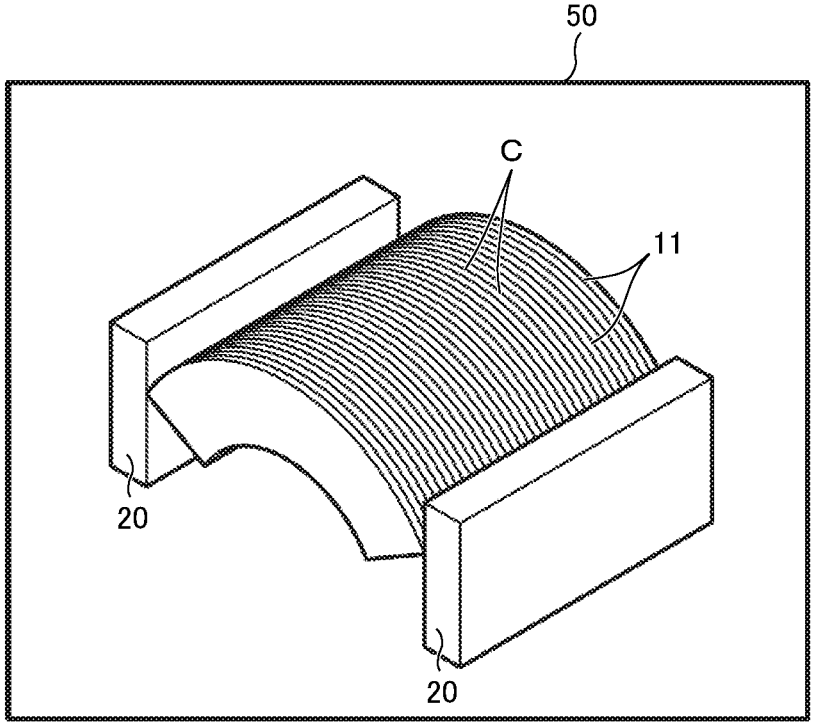
FIG. 8D is a schematic perspective view for explaining a crystallization step of FIG. 7.

Next, a crystallization step S4 is performed. In this step, as illustrated in FIG. 8D, the plurality of metal foils 11, 11 as separated is disposed in a heating device 50 so that the metal foils 11 are heated. The heating device 50 is filled with air or inert gas, and in this gas atmosphere, the metal foils 11 are heated at 440° C. for 60 seconds, for example, so that the amorphous soft magnetic material of the metal foils 11 is crystalized into nano-crystal soft magnetic material. In the present embodiment, heated gas (hot air) is flown between the metal foils 11, 11. In the present embodiment, since the gap C is formed between the metal foils 11, 11, each metal foil 11 is uniformly heated. In addition, although each metal foil 11 generates heat by itself during crystallization, since the gap C is formed between the metal foils 11, 11, it is possible to discharge the heat generated by the metal foil 11 through the gap C.

Figure 8E:
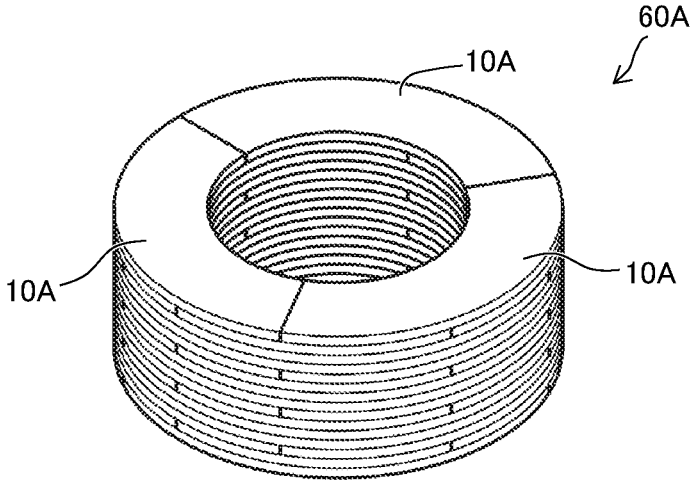
FIG. 8E is a schematic perspective view for explaining a fixing step of FIG. 7.
Figure 8F:
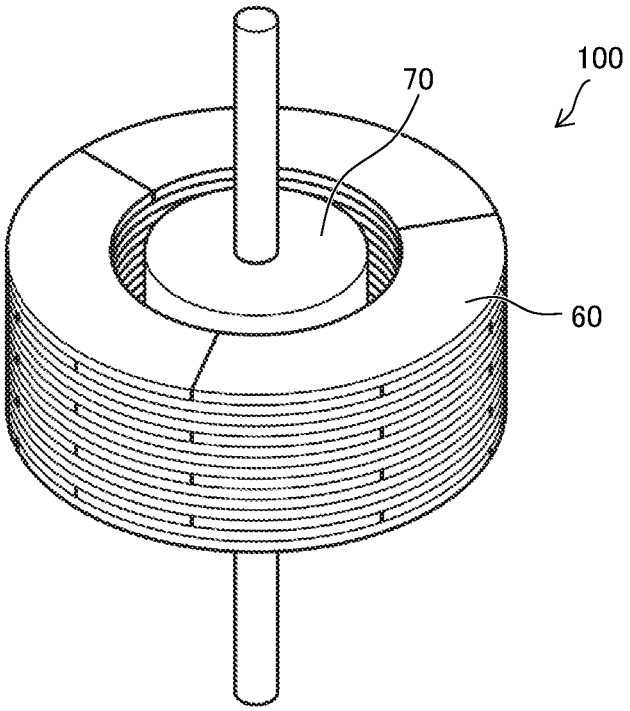
FIG. 8F is a schematic perspective view for explaining an assembling step of FIG. 7.

Next, a fixing step S5 is performed. In this step, the separated metal foils 11, 11 are removed from the heating device 50 and brought into close contact with each other with a predetermined pressure to form a laminate 10A. At this time, the metal foils 11 may be tied to each other with a resin such as an adhesive. Furthermore, as illustrated in FIG. 8E, a plurality of such laminates 10A is stacked in the state of a stator core and are fixed, whereby a stator core 60A is produced.

Finally, an assembling step S6 is performed. In this step, a coil (not illustrated) is disposed on teeth (not illustrated) of the stator core to form a stator 60, and the stator 60 and a rotor 70 are disposed in a case (not illustrated), whereby a motor 100 is produced.

While the embodiments of the present disclosure have been described in detail above, the present disclosure is not limited thereto, and can be subjected to various kinds of changes of design without departing from the spirit and scope of the present disclosure described in the claims.

In the present embodiment, a stator core of a motor is produced by laminating metal foils made of nano-crystal soft magnetic material, but a rotor core of a motor may be produced by laminating metal foils.

What is claimed is:

1. A method for producing metal foils made of nano-crystal magnetic material, the method comprising:

disposing separating members each including at least a magnet on opposite sides of a laminate obtained by laminating a plurality of metal foils made of amorphous soft magnetic material, in a laminated direction of the laminate, and magnetizing the metal foils forming the laminate using the magnet, so as to separate the metal foils that are adjacent to each other in the laminated direction and form a gap between the metal foils; and heating the plurality of metal foils with the gap formed between the metal foils, thereby crystalizing the amorphous soft magnetic material of each of the metal foils into nano-crystal magnetic material.

2. The method for producing metal foils according to claim 1, wherein a portion of each separating member facing the laminate includes a first portion and a second portion alternately disposed in the laminated direction of the laminate, the first portion being adapted to magnetize one of the metal foils using magnetism of the magnet, the second portion being adapted to block the magnetism of the magnet.

* * * * *